US005467101A

United States Patent [19]

Josefsson

[11] Patent Number: 5,467,101

[45] Date of Patent: Nov. 14, 1995

[54] WAVEGUIDE ANTENNA WITH TRANSVERSAL SLOTS

[75] Inventor: Lars G. Josefsson, Askim, Sweden

[73] Assignee: Telefonaktiebolaget LM Ericsson, Stockholm, Sweden

[21] Appl. No.: 274,448

[22] Filed: Jul. 13, 1994

[30] Foreign Application Priority Data

Jul. 13, 1993 [SE] Sweden ..... 9302412

[51] Int. Cl.[6] ..... H01Q 13/10

[52] U.S. Cl. ..... 343/771; 343/770

[58] Field of Search ..... 343/767, 770, 343/771, 768, 746; H01Q 13/10

[56] References Cited

U.S. PATENT DOCUMENTS 2,767,397 10/1956 Byrne ..... 343/771

5,172,127 12/1992 Josefsson ..... 343/771

FOREIGN PATENT DOCUMENTS 378905 7/1990 European Pat. Off. .

*Primary Examiner*—Donald T. Hajec
*Assistant Examiner*—Hoanganh Le
*Attorney, Agent, or Firm*—Burns, Doane, Swecker & Mathis

[57] ABSTRACT

A waveguide antenna comprising a waveguide in one wall of which a number of transversal slots are arranged. In connection with the transversal slots, electrically conducting waveguide elements are arranged which are located parallel to the wavelength wall and substantially symmetrically with respect to the transversal slots. In this way new slots are formed at the ends of the waveguide elements.

10 Claims, 2 Drawing Sheets

WAVEGUIDE ANTENNA WITH TRANSVERSAL SLOTS

The present invention relates to a waveguide antenna with transversal slots and more particularly to a waveguide antenna with transversal slots in which grating lobes can be eliminated, load impedance can be varied, and the bandwidth of the antenna can be increased.

BACKGROUND

Within the microwave range and higher frequency ranges various types of antennas are used. The slot antenna is such a type of antenna where slots constitute the radiating elements of the antenna. The radiating elements/slots are fed by means of various forms of transmission lines such as waveguides, strip-lines etc. Among other things, the characteristics of the antenna are affected by the location and the design of the slots and the radiation pattern of the antenna is defined by the interaction between the slots.

In its most simple form a slot antenna may consist of a waveguide in the wide side of which a number of longitudinal slots is arranged. The length of the slot is $\approx\lambda_0/2$ where $\lambda_0$ is the wavelength in free space and the slots are located with a pitch of $\lambda_g/2$ where $\lambda_g$ is the wavelength in the waveguide.

In this type of slot antennas, the feeding of the slots is controlled by their being displaced sideways from the waveguide center line. Alternating sideways displacement results in the 180° phase correction which is necessary for the slots to radiate with the same mutual phase in spite of the location at the distance $\lambda/2$.

An advantage with the slot location is that no grating lobes are generated because the distance between the slots is less than one wavelength.

However, in certain applications an antenna with the opposite direction of polarization is wanted. This is possible with transversal slots, i.e. slots which are placed across the longitudinal direction of the waveguide. However, in this case the earlier mentioned possibility to switch the phase by sideways displacement is lacking. The transversal slots must therefore be arranged with the mutual distance $\lambda_g$. This results in considerable grating lobes because normally $\lambda_g>\lambda_0$ (typically $\lambda_g\approx1.4\ \lambda_0$).

The grating lobes can be suppressed in various ways. For example, in the Swedish patent application SE 9000959-8 a method to suppress grating lobes by means of baffles is described. Another way to achieve the same purpose is to fill the waveguide with a dielectric material with $\epsilon>2$. Both the methods have their limitations and are therefore sometimes less suitable.

Transversal slots in waveguides also have a high equivalent impedance (R). For normal height of the waveguide, $R/Z_0\approx1$ (where $Z_0$ is the characteristic impedance of the waveguide) is valid, but for so-called half-height twice that value, i.e. $R/Z_0\approx2$, is achieved. As the antenna has several slots in the same waveguide, the total load impedance will be very high and a transformation of the input impedance will be necessary. Besides the difficulty with the matching, the high slot impedance will cause the bandwidth of the antenna to be limited.

SUMMARY

The object of the invention is therefore to provide a waveguide antenna with transversal slots in which the grating lobes are eliminated and in which the slot impedance is reduced so that the total load impedance is reduced to more optimal values at the same time as the bandwidth of the antenna is increased. These and other objects are achieved by a waveguide antenna according to the present invention.

DETAILED DESCRIPTION

Figure 1:
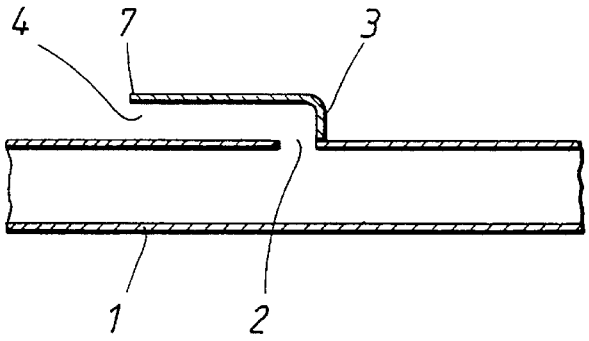
FIG. 1 shows in a partial view a longitudinal section through an embodiment of a waveguide antenna.
Figure 2:
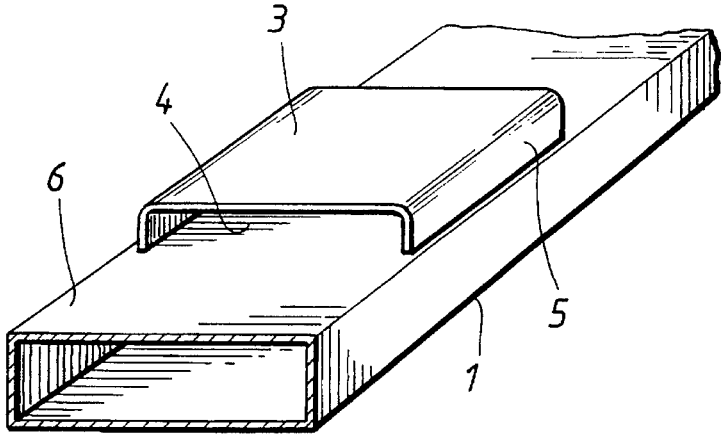
FIG. 2 is a perspective partial view of the waveguide antenna of FIG. 1.
Figure 3:
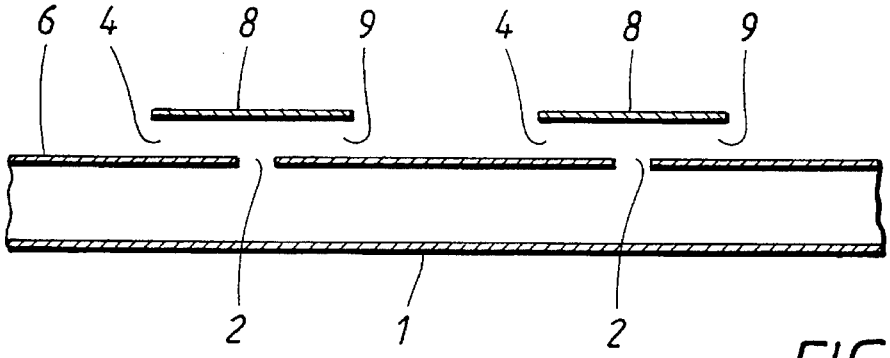
FIG. 3 shows in a partial view a longitudinal section through an embodiment of a waveguide antenna according to the invention.

The invention will now be described in detail with reference to FIGS. 1–7.

The invention is based upon theoretical studies which show that the slot impedance can be affected if the slot is "extended" by increasing the thickness of the waveguide wall. As an example, it can be mentioned that for a waveguide with height 10 mm and wall thickness 1 mm $R/Z_0$ will be $\approx2$ while an increase of the wall thickness to the extreme 30 mm results in $R/Z_0\approx0.1$. However, from, among other things, weight and space points of view, it is usually not realistic to utilize such wall thicknesses.

It has, however, appeared to be possible to achieve the same advantages with an arrangement according to the invention. However, in order to facilitate the understanding of the invention, an arrangement according to FIG. 1 and 2 will first of all be described. The figures show a waveguide 1 provided with a transversal slot 2. Along one side of the slot an electrically conducting waveguide element 3 is attached. The waveguide element attached to the side of the slot protrudes perpendicularly to the wall 6 of the waveguide 1, but is bent at a certain distance from the waveguide wall 6 so that it essentially becomes parallel to the waveguide wall. At the free end 7 of the waveguide element an opening is formed which functions as a new slot, hereinafter termed secondary slot 4. The width of the waveguide element 3 is equal to or greater than the length of the transversal slots 2 and may be provided along its sides with side walls 5 in contact with the waveguide wall 6.

The bent waveguide element 3, together with the waveguide wall 6, form an "extension" of the slot 2 in the form of a waveguide up to the secondary slot 4. The distance between the two slots 2 and 4 corresponds in that respect to the earlier mentioned wall thickness. By varying the distance between the slots, the slot impedance and accordingly the total load impedance can thus be affected.

Because the mutual distance between the secondary slots 4 will be the same as the mutual distance between the slots 2, i.e. $\lambda_g$, grating lobes will however appear. These may however be eliminated by the design of the waveguide element which is characteristic for the invention.

Various embodiments of the invention will be described in the following with reference to FIGS. 3–7. In this connection, it is to be noted that even if certain of these figures, for the sake of clarity, only show arrangements around one or a couple of transversal slots, the invention relates to waveguide antennas which normally comprise a larger number of slots. The arrangement described are thus intended to be arranged at all slots.

As earlier, reference number 1 in FIG. 1 denotes a waveguide provided with transversal slots 2. In connection to each slot a waveguide element 8 is located. This waveguide element differs from that described in connection with FIG. 1 and 2 because it is not attached along the side of the slot 2, but is essentially symmetrically located above the slot 2. As for the earlier described embodiment, a secondary slot 4 is formed at one end of the waveguide element. Due to the design of the waveguide element 8, a secondary slot 9 is also formed at its other end.

As the slots 2 are located at the mutual distance $\lambda_g$, the mutual distance between the secondary slots will be $\lambda_g/2$ if the length of the waveguide element 8 is made $\lambda_g/2$. This means that grating lobes will not be generated.

Figure 4:
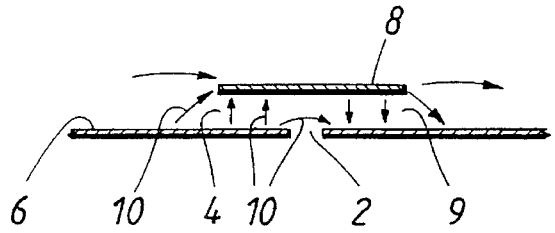
FIG. 4 shows the electrical field pattern around an arrangement according to FIG. 3.
Figure 5:
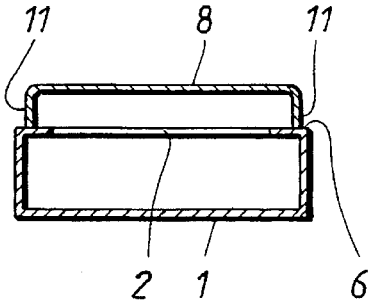
FIG. 5 & 6 are cross-sections of various embodiments of the invention.

The waveguide element 8 in combination with the slot 2 and the waveguide wall 6 can be regarded as a waveguide junction in which the energy radiated from the slot 2 is distributed to the two secondary slots 4 and 9. The electric field lines 10 in the waveguide junction are indicated in FIG. 4. As is evident from the figure, the two secondary slots will radiate in phase.

The width of the waveguide element 8 is normally equal to or greater than the length of the transversal slots. Like the waveguide element 3, the waveguide element 8 may be provided with side walls 11. This is evident from FIG. 5 which shows an embodiment in which the waveguide element is made in the form of a U-shaped profile, the legs of which constitute the side walls 11. The legs are attached to the waveguide wall 6 by means of gluing, soldering or other suitable methods, which implies a simple and uncomplicated production of the antenna.

Figure 6:
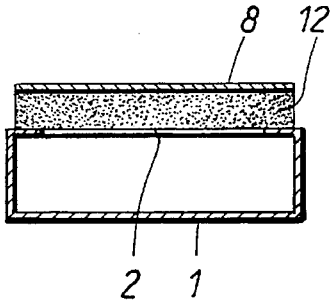

FIG. 6 shows an embodiment of the invention in which the waveguide element 8 is without side walls. Instead, the waveguide element is placed on a plate 12 of a dielectric material.

The distance between the waveguide wall 6 and the waveguide element 8 is dependent upon the slot impedance which is desired though it is of the order 0.2–1 times the height of the waveguide 1.

Figure 7:
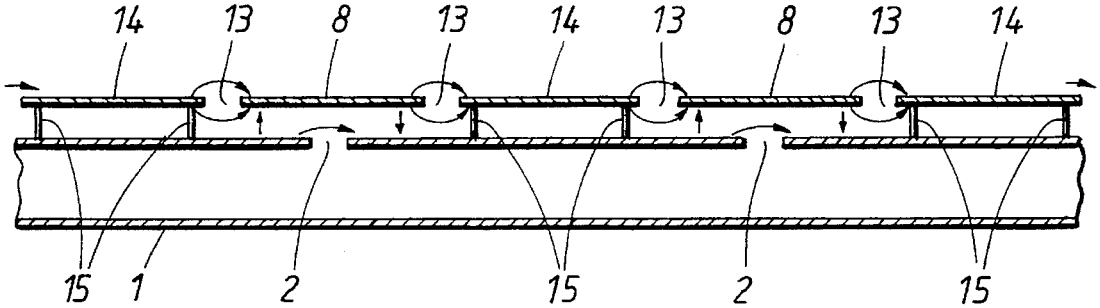
FIG. 7 shows in a partial view a central longitudinal section through an additional embodiment of the arrangement according to the invention.

For practical reasons, it might be desirable to give the waveguide antenna a smoother surface. FIG. 7 shows an embodiment in which a second waveguide element 14 is located between each waveguide element 8. This second waveguide element 14 is somewhat shorter than the distance between the waveguide elements 8, by means of which secondary slots 13 are formed between the waveguide elements 8 and the second waveguide element 14. At both ends the second waveguide element 14 is provided with galvanic connections 15 with the waveguide 1. Due to the galvanic connection the radiation from adjacent transversal slots 2 is prevented from affecting each other. Thus in this embodiment the secondary slots 13 are located on the surface of the waveguide antenna, symmetrically around the transversal slots 2 and with the mutual distance $\lambda_g/2$. For the sake of clarity, the electric field lines are also indicated in FIG. 7.

Thus the grating lobes which appear with waveguide antennas with transversal slots have been eliminated by means of the now described arrangement. By varying the height and width of the waveguide element, the slot impedances and accordingly the total load impedance can be varied, which implies that a good matching of the antenna to the feeding source can be achieved. This also means an increased antenna bandwidth.

In the examples described, the distance between the secondary slots has been said to be $\lambda_g/2$. However this value is in no way a condition for the function of the invention. It is thus possible to adjust the elimination of the grating lobes and other radiation characteristics to the design requirements by varying the distance between the secondary slots.

The invention is not limited to the above described embodiments but can be varied within the scope of the appended claims.

I claim:

1. A waveguide antenna comprising:

a waveguide having a waveguide wall including a plurality of first transversal slots; and a plurality of electrically conductive first waveguide elements, each first waveguide element having a surface parallel to the waveguide wall and being displaced outwardly from the waveguide wall such that a plurality of second transversal slots is formed between the waveguide elements and the waveguide wall, wherein each first waveguide element includes at least one side wall which extends from the waveguide element to the waveguide forming one second transversal slot; and each first waveguide element is attached at one end to a side of a respective first transversal slot, a portion of each first waveguide element protruding substantially perpendicularly to the waveguide wall for predetermined distance, and the remaining portion of each first waveguide element being disposed above the respective first transversal slot substantially parallel to the waveguide wall.

2. The waveguide antenna of claim 1, wherein a distance along the waveguide between two successive first transversal slot is substantially equal to a wavelength of a wave in the waveguide.

3. The waveguide antenna of claim 1, wherein a length of a first waveguide element along the waveguide is substantially equal to half of a wavelength of a wave in the waveguide.

4. The waveguide antenna of claim 1, wherein a width of a first waveguide element across the waveguide is at least substantially equal to a length of the first transversal slots across the waveguide.

5. The waveguide antenna of claim 1, wherein a dielectric material is disposed between a first waveguide element and the waveguide.

6. The waveguide antenna of claim 1, wherein each first waveguide element is centered above a respective first transversal slot.

7. The waveguide antenna of claim 6, wherein each first waveguide element forms two second transversal slots.

8. The waveguide antenna of claim 7, wherein a length of a first waveguide element along the waveguide is substantially equal to half of a wavelength of a wave in the waveguide.

9. The waveguide antenna of claim 1, further comprising a plurality of second waveguide elements, each second waveguide element being galvanically connected to the waveguide and disposed between two successive first waveguide elements such that the second transversal slots are formed between the waveguide elements and the second waveguide elements.

10. The waveguide antenna of claim 9, wherein a distance between two successive second transversal slots is substantially equal to half of a wavelength of a wave in the waveguide.

* * * * *